US010732559B2

(12) United States Patent
Downing et al.

(10) Patent No.: US 10,732,559 B2
(45) Date of Patent: Aug. 4, 2020

(54) FINISHING DEVICE FAILURES

(71) Applicant: Hewlett-Packard Development Company, L.P., Houston, TX (US)

(72) Inventors: Elliott Downing, Vancouver, WA (US); Robert Yraceburu, Camas, WA (US); Lorraine T. Golob, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 234 days.

(21) Appl. No.: 16/018,208

(22) Filed: Jun. 26, 2018

(65) Prior Publication Data

US 2019/0391520 A1 Dec. 26, 2019

(51) Int. Cl.

| | |
|---|---|
| ***G03G 15/00*** | (2006.01) |
| ***B65H 7/06*** | (2006.01) |
| ***B65H 31/24*** | (2006.01) |

(52) U.S. Cl.

CPC ..... *G03G 15/70* (2013.01); *B65H 7/06* (2013.01); *B65H 31/24* (2013.01); *G03G 15/6538* (2013.01); *B65H 2511/52* (2013.01)

(58) Field of Classification Search

CPC ..... B65H 7/06; B65H 31/24; B65H 2511/52; G03G 15/70; G03G 15/6538

See application file for complete search history.

(56) References Cited

U.S. PATENT DOCUMENTS

| | | | | |
|---|---|---|---|---|
| 4,133,477 | A | 1/1979 | Marino et al. | |
| 5,161,795 | A | 11/1992 | Kim et al. | |
| 5,268,728 | A | 12/1993 | Sugiyama et al. | |
| 5,619,246 | A * | 4/1997 | Straayer | H04N 1/0057 347/262 |
| 5,898,592 | A * | 4/1999 | Salgado | B65H 31/02 270/52.03 |
| 6,443,449 | B1 * | 9/2002 | Takagi | B65H 31/22 271/279 |
| 7,228,079 | B2 | 6/2007 | Brown et al. | |
| 8,213,853 | B2 | 7/2012 | Levin et al. | |
| 8,913,273 | B2 | 12/2014 | Oakley et al. | |
| 2010/0061746 | A1 * | 3/2010 | Matsuoka | G03G 15/5029 399/45 |
| 2014/0003836 | A1 * | 1/2014 | Burchette | G03G 21/1889 399/109 |
| 2015/0277335 | A1 | 10/2015 | Bradford et al. | |
| 2017/0282634 | A1 * | 10/2017 | Jones | B65H 5/26 |
| 2018/0017923 | A1 * | 1/2018 | Ohta | G03G 15/556 |
| 2019/0191047 | A1 * | 6/2019 | Ueda | H04N 1/00633 |

FOREIGN PATENT DOCUMENTS

| | | | |
|---|---|---|---|
| EP | 0768266 | A1 | 4/1997 |

* cited by examiner

*Primary Examiner* — David H Banh

(74) *Attorney, Agent, or Firm* — Brooks Cameron & Huebsch PLLC

(57) ABSTRACT

An example printing device may comprise a first bin to receive print media, where the first bin is a non-finishing bin, a second bin to receive print media, where the second bin is a finishing bin, a finishing device, and a controller to determine a total number of finishing device failures and redirect a print job from the second bin to the first bin in response to a determination that the total number of finishing device failures exceeds a threshold value.

15 Claims, 5 Drawing Sheets

FINISHING DEVICE FAILURES

BACKGROUND

Imaging systems, such as printers, may allow text, images, and/or graphics, etc. to be printed onto print media (e.g., paper, plastic, etc.). Imaging systems may include a stacking region for the collection of print media. Imaging systems may be provided with a finishing device where the print media may be collected for a finishing process, such as stapling, three-hole punching, etc.

DETAILED DESCRIPTION

Printing devices, such as printers, may allow text and/or images from a computing device to be printed onto a print medium, such as paper. A printing device may include a first bin and second bin to receive printed sheets of print media after the processing of print media. In addition, a printing device may include a finishing device. A finishing device may include mechanisms to process printed sheets of print media following the printing process.

Processing printed sheets of print media may include transporting, stacking, aligning, collating, stapling, etc. the print medium. The finishing device may utilize various mechanisms to process the print medium. For example, the finishing device may utilize various mechanisms to control the print medium throughout the finishing process (e.g., post processing).

However, if a finishing device is unable to perform a finishing process the printing device may not print on print media stopping the printing process. For example, if the mechanisms of the finishing device are not properly functioning the printing device may not deliver print media to an output region and a user may not receive print media from the print job. That is, the printing device may not process print media if the finishing device is unable to perform a finishing process.

Accordingly, this detailed description describes finishing device failures and printing devices that allow a printing process to continue if a finishing device failure occurs. For example, the printing device may include a controller to determine when a finishing device failure occurs. In addition, if a finishing device failure occurs the controller may send the print media to a first bin (e.g., non-finishing bin) and not a second bin (e.g., finishing bin) to continue the print process. As used herein, "non-finishing bin" refers to a bin that receives print media that has not been through a finishing process. As used herein, "finishing bin" refers to a bin that receives print media that has been through a finishing process.

Figure 1:
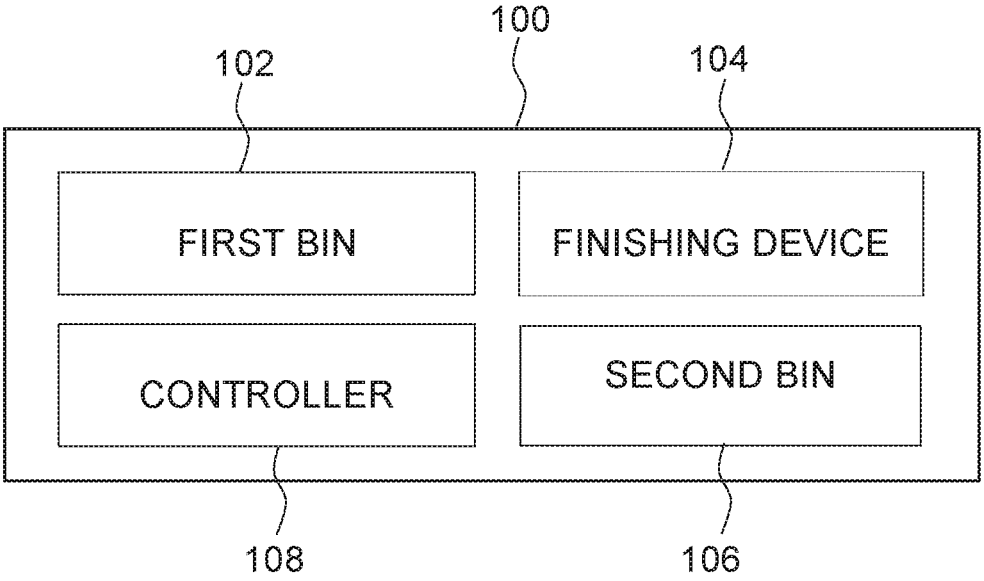
FIG. 1 illustrates an example printing device including a finishing device.

FIG. 1 illustrates an example printing device 100 including a finishing device 104. The printing device 100 may be implemented in a variety of imaging systems, such as printers, copiers, etc., for example. As used herein, "printing device" refers to a hardware device that transfers print substance on to a print medium such as paper and includes a finishing device; a standalone hardware device that transfers print substance on to a print medium that is not connected to a finishing device, and/or a hardware device that transfers print substance on to a print medium that is connected to a removable external finishing device.

For example, a printing device 100 may include a printer that may deposit print substance onto the print media to form a marking. As used herein, "print media" may include paper, photopolymers, plastics, composite, metal, wood, or other material on which markings may be formed. A print medium may refer to a piece of print media (e.g., a sheet of paper) upon which markings may be formed to make up a physical representation of the output of a print job or a portion of an output of a print job.

As used herein, "print job" refers to signals or states, which may be stored in a file and/or a set of files, usable to instruct a printing device in forming text, images, and/or objects on print media. Among other things, the print job may include information relating to the print media. For example, a print job may include information such as an amount of print medium to be used in forming text, images, and/or objects on print media, a size or format (e.g., dimensions) of the printed medium, a paper type (e.g., paper weight, thickness, recycled content etc.), of the print medium.

In some examples, the printing device 100 may include a first bin 102 to receive print media. The first bin 102 may be a non-finishing bin in which print media is delivered to and/or stacked. For example, print media may compile at a first bin 102 after processing of the print media. As used herein, "bin" refers to an output region for print media to accumulate after a printing process and/or finishing process is complete. For example, the printing device may include a first bin to receive print media after processing of print media. In addition, a printing device may include a second bin 106 to receive print media after a finishing process. In some examples, the first bin 102 and the second bin 106 may be attached to the finishing device 104. However, this detailed description is not so limited. In some examples, the first bin 102 may be attached to the printing device 100 and the second bin 106 may be attached to the finishing device 104, among other possibilities.

In some examples, the finishing device 104 may be integrated into the printing device 100. However, this description is not so limited. In some examples, the finishing device 104 may be an external finishing device that is removable attached to the printing device 100. As used herein, "finishing device" refers to a mechanical and/or electrical component to perform finishing operations. In some examples, the finishing device 104 may be a finisher or a portion of the printing device and/or the finishing tray. In some examples, a finishing process may be performed on a print job by a finishing device (e.g., a finisher), which may be included in a printing device 100, included in the finishing tray, and/or external to the printing device 100.

In some examples, a finishing device 104 may include a device that may perform a finishing process on print media. For example, the finishing device 104 may be a device that may perform a folding process, a stapling process, a collating process, a three-hole punch process among other finishing processes on print media received from a printing device 100. In some examples, print media may be transported from the printing device 100 to a media support of the finishing device 104. In some examples, the media support may include a media support sensor to identify when the media support is aligned with the channel included in the finishing device 104. In some examples, after the finishing process is complete the print media may be transported to a second bin 106. The second bin 106 may be a finishing bin in which print media is delivered to and/or stacked after a finishing process.

However, in some examples, a finishing device 104 may not be able to perform a finishing process on print media due to a finishing device failure. For example, if a finishing device 104 fails to successfully initialize a finishing device failure may occur. That is, mechanisms of the finishing device 104 may not respond to a printing device 100 during the initial power up of the finishing device 104 due to various failures in the finishing device 104. For example, if the second bin 106 is not in a position to receive print media during a power up of a finishing device 104 a finishing device failure may occur. As used herein, "initialize" refers to the process of activating the finishing device mechanisms. As used herein, "successfully initialize" refers to successfully completing the initialization process of the finishing device. For example, the finishing device 104 successfully initializes if the finishing device 104 powers up and all of the finishing device mechanisms are properly functioning.

In some examples, a finishing device failure may occur if a second bin sensor fails to respond to a printing device 100. In addition, a finishing device failure may occur if the diverter in the finishing device 104 malfunctions. In some examples, a finishing device failure may occur if the media support sensor is unable to identify if the media support is aligned with the channel included in the finishing device. In addition, a finishing device failure may occur if the second bin 106 is unable to receive print media. As used herein, "finishing device failure" refers to a mechanism malfunction of the finishing device. As used herein, a "mechanism malfunction" refers to a device and/or mechanism included inside and outside of the finishing device not functioning. Examples of finishing device failures include an inability of the finishing device to power up, a finishing device that does not respond to signals, and/or otherwise not being capable of performing a finishing process due to a mechanism malfunction of the finishing device.

In some examples, a finishing device failure may occur if the finishing bin (e.g., the second bin 102) is not properly positioned to receive print media. For example, if the second bin 102 is fixed in a position and unable to move a finishing device failure may occur. In various examples, if a finishing device failure occurs the printing device 100 may send print media from the print job to a first bin 102. For example, if a finishing device 104 is not functioning properly the printing device 100 may send the print media to a non-finishing bin and/or non-finishing output zone. That is, the print media from the print job may not undergo a finishing process, but rather be sent to the first bin 102 after the transfer of print substance onto print media. In some examples, if a finishing device 104 is not responding to the printing device 100 the finishing device 104 may be removed and the printing process may continue. For example, if the finishing device 104 is a removable external finishing device the finishing device 104 may be removed when a finishing device failure occurs, and print media may be redirected to a non-finishing output region.

In some examples, the printing device 100 may alert a user to remedy a finishing device failure if a finishing device failure occurs. For example, if the second bin 106 is at capacity the controller 108 may determine the type of finishing device failure that occurred and send a request to the user to empty the second bin 106. In addition, in the case of a removable external finishing device, if a finishing device 104 is not responding to the printing device 100 the controller 108 may determine the type of finishing device failure that occurred and send a request to the user to remove the external finishing device to continue the printing process.

In some examples, the controller 108 may determine the total number of finishing device failures the finishing device 104 experiences. In various examples, if the total number of finishing device failures exceeds a threshold value the controller 108 may redirect the print media from the print job to a first bin 102 or non-finishing bin. In addition, the controller 108 may disable the finishing device 104. For example, the controller 108 may place the finishing device 104 in a sleep mode and/or not send print media from a print job to the finishing device 104 for a finishing process. As used herein, "disable the finishing device" refers to the finishing device no longer receiving print media to perform a finishing process. In some examples, the total number of finishing device failures may exceed the threshold value in response to the finishing device 104 indicating a permanent failure. That is, if the finishing device 104 is unable to perform a finishing process the finishing device 104 may indicate permanent failure. In some examples, the threshold value is a user defined value. That is, the threshold value may be set by a user. As used herein, "permanent failure" refers to a finishing device failure that causes the finishing device to be incapable of performing a finishing process and/or a finishing device that is not responding to the printing device. For example, if a mechanism in the finishing device 104 is unable to participate in the finishing process until the mechanism is repaired.

In some examples, if the total number of finishing device failures does not exceed a threshold value the controller 108 may reattempt to power up the finishing device 104. That is, the controller 108 may make another attempt to send print media to the finishing device 104 for a finishing process. The controller may store the total number of finishing device failures on a memory resource (e.g., memory resource 332 of FIG. 3). In some examples, if the finishing device 104 successfully initializes after the power up reattempt the memory resource may reset the total number of finishing device failures to zero. In addition, the memory resource may reset the total number of finishing device failures to zero if the printing device 100 is turned off and then back on. As used herein, "power up" refers to activating the finishing device and/or printing device from a reduced power state and/or off power state.

Figure 2:
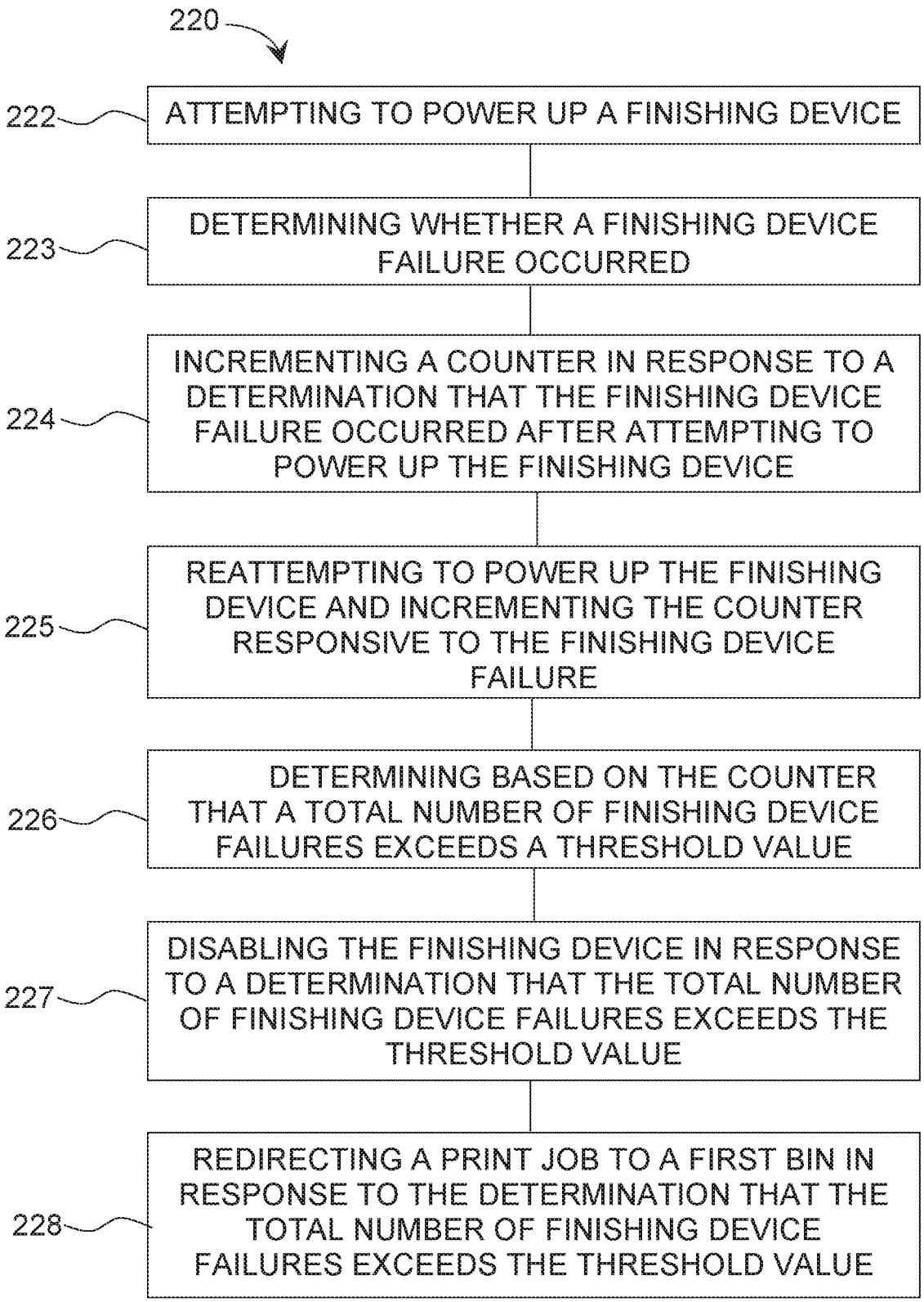
FIG. 2 illustrates an example method suitable for use with printing devices.

FIG. 2 illustrates an example method 220 to a printing device. Method 220 may be performed, for example, by a controller (e.g., controller 108 of FIG. 1). At 222, the method 220 may include attempting to power up a finishing device. In some examples, after a printing device has processed print media the printing device may send print media to a finishing device for a finishing process. In some examples, before the printing device sends the print media to the finishing device for a finishing process a controller may attempt to power up the finishing device. However, after the finishing device is powered up the controller may run a finishing device system check to determine if the finishing device is functioning properly. In some examples, if a function or finishing device mechanism is not responding to the controller a finishing device failure may have occurred.

At 223, the method 220 may include determining whether a finishing device failure occurred. In some examples, the controller may determine if a finishing device failure has occurred. That is, a finishing device failure may occur if mechanisms of the finishing device fail to respond to the controller after a finishing device power up and/or if a finishing device mechanism is not functioning properly. For example, a finishing device failure may occur if a second bin sensor fails to respond to the controller of the printing device, the finishing device diverter fails to respond to the controller or has malfunctioned, the media support sensor fails to respond to the controller, the media support sensor is unable to identify if the media support is aligned with the channel included in the finishing device; and/or the second bin is unable to receive print media. In addition, a finishing device failure may occur if the finishing device does not power up, among other possibilities.

At 224, the method 220 may include incrementing a counter in response to a determination that the finishing device failure occurred after attempting to power up the finishing device. In some examples, a memory resource (memory resource 332 of FIG. 3) may keep track of the total number of times a finishing device failure occurs. That is, the counter may increase each time a failure occurs during a power up. In some examples, the memory resource may reset the counter to zero upon successful initialization of the finishing device. That is, once the finishing device powers up and all the mechanism of the finishing device are functioning and able to perform a finishing process the memory resource may reset the counter to zero.

At 225, the method 220 may include reattempting to power up the finishing device and incrementing the counter responsive to the finishing device failure. In some examples, if the counter has not reached a threshold value the controller may attempt to power up a finishing device again. That is, the controller may reattempt to power up the finishing device in efforts to successfully initialize the finishing device for a finishing process. However, if the finishing device fails to successfully initialize again then the counter may increase by one.

At 226, the method 220 may include determining based on the counter that a total number of finishing device failures exceeds a threshold value. In some examples, a total number of allowed finishing device failures is preset into the printing device. That is, if the counter reaches a preset number the controller may determine that a total number of finishing device failures exceeds a threshold value. In some examples, the threshold value is set by a user. That is, the threshold value may be a user defined value. In some examples, the controller may determine that the threshold value has been reached if the finishing device indicates a permanent failure. That is, the counter stored on the memory resource may increase the total number of finishing device failures above the threshold value if the finishing device indicates a permanent failure.

At 227, the method 220 may include disabling the finishing device in response to a determination that the total number of finishing device failures exceeds the threshold value. In some examples, if the finishing device failures exceed a threshold value the finishing device may not be able to perform a finishing process. If the finishing device is not able to perform a finishing process the controller may disable the finishing device to prevent print media from going to the finishing device for a finishing process. In some examples, disabling the finishing device may allow a user to receive the print media. That is, the print media may be sent to a first bin (e.g., first bin 102 of FIG. 1) for user access.

At 228, the method 220 may include redirecting a print job to a first bin in response to the determination that the total number of finishing device failures exceeds the threshold value. In some examples, if the finishing device is unable to perform a finishing process on the print media the print media may be sent to a first bin. The first bin may be a non-finishing bin. That is, in order to ensure the user receives the print media from the print job the print media is sent to a non-finishing bin. In addition, the printing process may not stop due to a finishing device failing to successfully initialize.

Figure 3:
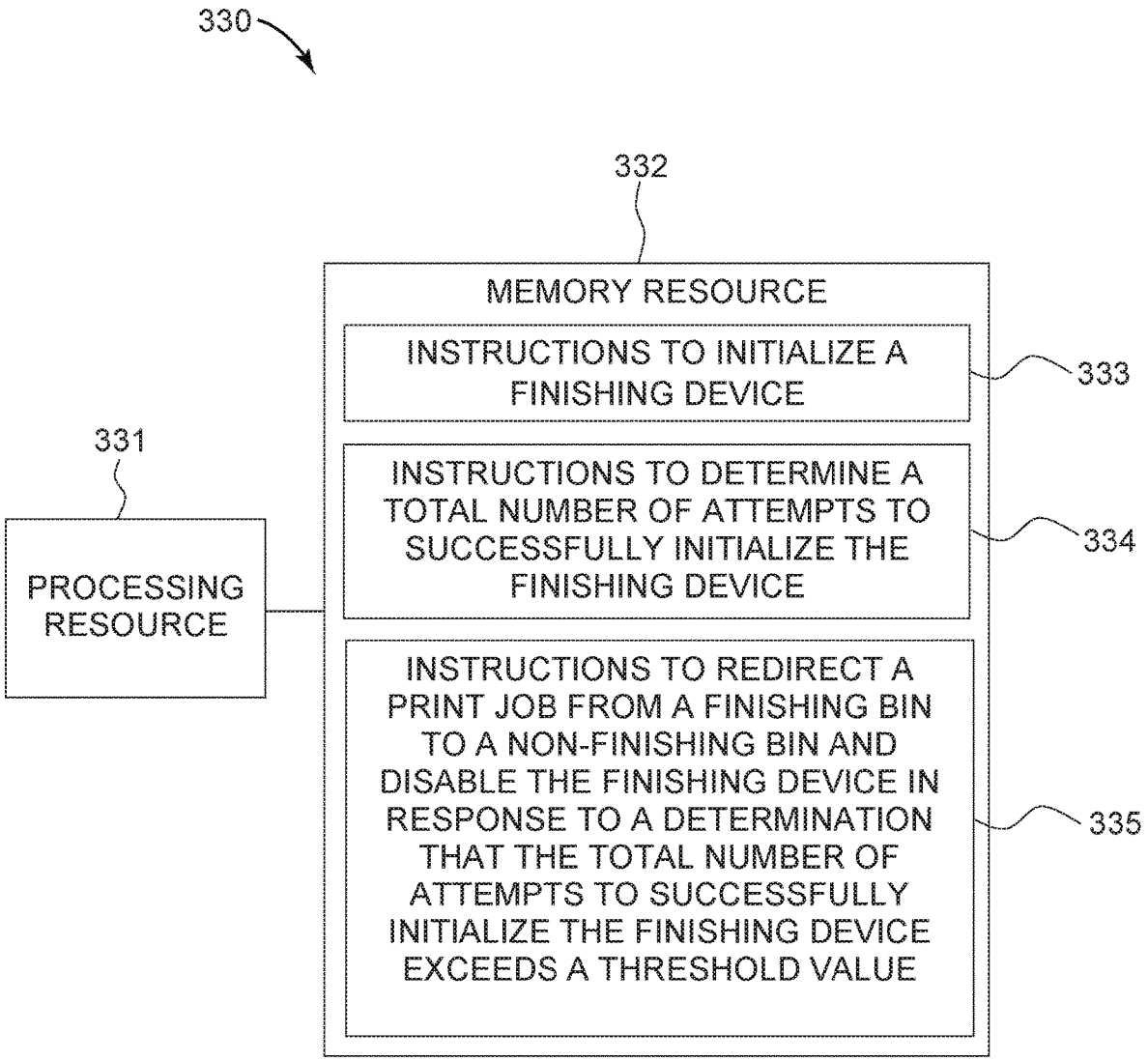
FIG. 3 illustrates an example processing resource and an example memory resource of an example apparatus including a printing device.

FIG. 3 illustrates an example processing resource 331 and an example memory resource 332 of an example apparatus including a printing device. As illustrated in FIG. 3, the apparatus 330 includes a processing resource 331 and a memory resource 332. The processing resource 331 may be a hardware processing unit such as a microprocessor, application specific instruction set processor, coprocessor, network processor, or similar hardware circuitry that may cause machine-readable instructions to be executed. In some examples, the processing resource 331 may be a plurality of hardware processing units that may cause machine-readable instructions to be executed. The processing resource 331 may include central processing units (CPUs) among other types of processing units. The memory resource 332 may be any type of volatile or non-volatile memory or storage, such as random-access memory (RAM), flash memory, read-only memory (ROM), storage volumes, a hard disk, or a combination thereof.

The memory resource 332 may store instructions thereon, such as instructions 333, 334, and 335. When executed by the processing resource 331, the instructions may cause the apparatus 330 to perform specific tasks and/or functions. For example, the memory resource 332 may store instructions 333 which may be executed by the processing resource 331 to cause the apparatus 330 to initialize a finishing device. In some examples, after the printing device processes the print media, the print media is sent to a finishing device for a finishing process. However, the finishing device may successfully initialize before print media is sent to the finishing device for a finishing process. That is, the finishing device may undergo a process to determine if the mechanisms of the finishing device are properly working.

The memory resource 332 may store instructions 334 which may be executed by the processing resource 331 to cause the apparatus 330 to determine a total number of attempts to successfully initialize the finishing device. In some examples, if the finishing device fails to successfully initialize within a set number of attempts the finishing device may be disabled. That is, if the finishing device fails to successfully initialize then it cannot perform a finishing process on print media. The finishing device may then be disabled so the printing process can continue without the finishing device performing a finishing process. That is, the print media may be sent to a non-finishing bin.

The memory resource 332 may store instructions 335 which may be executed by the processing resource 331 to cause the apparatus 330 to redirect a print job from a finishing bin to a non-finishing bin and disable the finishing device in response to a determination that the total number of attempts to successfully initialize the finishing device exceeds a threshold value. In some examples, the print media is redirected to a non-finishing bin because the finishing device is unable to successfully initialize. By redirecting the print media to a non-finishing bin the print process is able to continue allowing a user to receive the print media from the print job. That is, the printing process may not stop due to a finishing device failing to successfully initialize, but rather the processing resource may cause the apparatus to redirect the print media to a non-finishing bin.

Figure 4:
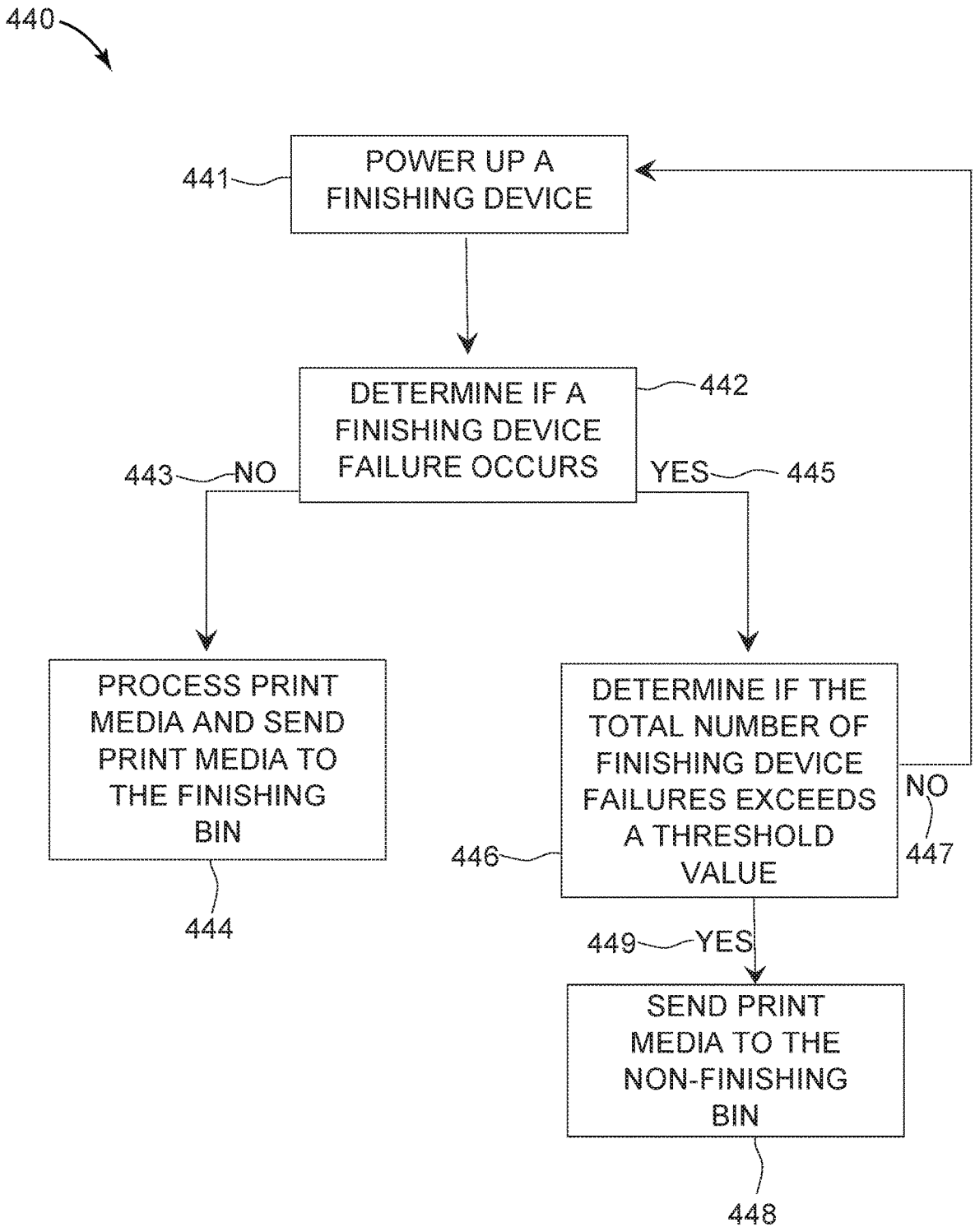
FIG. 4 illustrates an example flow diagram suitable for use with printing devices.

FIG. 4 illustrates an example flow diagram 440 to a printing device. As shown in FIG. 4, at block 441, a finishing device (e.g., finishing device 104 of FIG. 1) may attempt to power up. At block 442, a controller (e.g., controller 108 of FIG. 1) may determine if a finishing device failure has occurred. In some examples, if the controller determines that a finishing device failure has not occurred ("no" at 443), the controller may send print media to the finishing device for a finishing process and then to a finishing bin for a user to retrieve the print media, at block 444. In contrast, if the controller determines that a finishing device failure has occurred ("yes" at 445), the controller may determine if the total number of finishing device failures exceed a threshold value, at block 446.

In some examples, if the controller determines the total number of finishing device failures does not exceed a threshold value ("no" at 447), the controller may attempt to power up a finishing device. However, if the controller determines the total number of finishing device failures exceeds a threshold value ("yes" at 449), the controller may send the print media to a non-finishing bin and disable the finishing device, at block 448.

At block 442, the controller may determine if a finishing device failure occurs. That is, after the finishing device powers up the processor may determine if the mechanisms of the finishing device are properly working. For example, the controller may perform a finishing device system check to determine if the finishing device is properly functioning. If a finishing device failure does not occur ("no" 443) the controller may send the print media from the print job to the finishing device for a finishing process. That is, if a finishing device failure was not detected the print media may be sent to the finishing device for post processing.

At block 444, if the finishing device successfully initialized the printing device may process the print media and then the print media may be sent to the finishing device for post processing. For example, the finishing device may transport, stack, align, collate, or staple, etc. the print media during post processing. After the post processing of the print media, the print media may be sent to the user via an output region. That is, the print media may be sent to a finishing bin.

In contrast, at block 446, if it is determined that a finishing device failure has occurred ("yes" 445) the controller may then determine if the total number of finishing device failures exceeds a threshold value. If the threshold value has not been exceeded ("no" 447), the finishing device may be powered up again, at block 441.

At 448, if the controller determines that the total number of finishing device failures exceeds a threshold value ("yes" 449) the print media may be sent to the non-finishing bin after processing of the print media. That is, if the threshold value for the total number of finishing device failures is exceeded the print media may be sent to the non-finishing bin and may not undergo a post processing.

Figure 5:
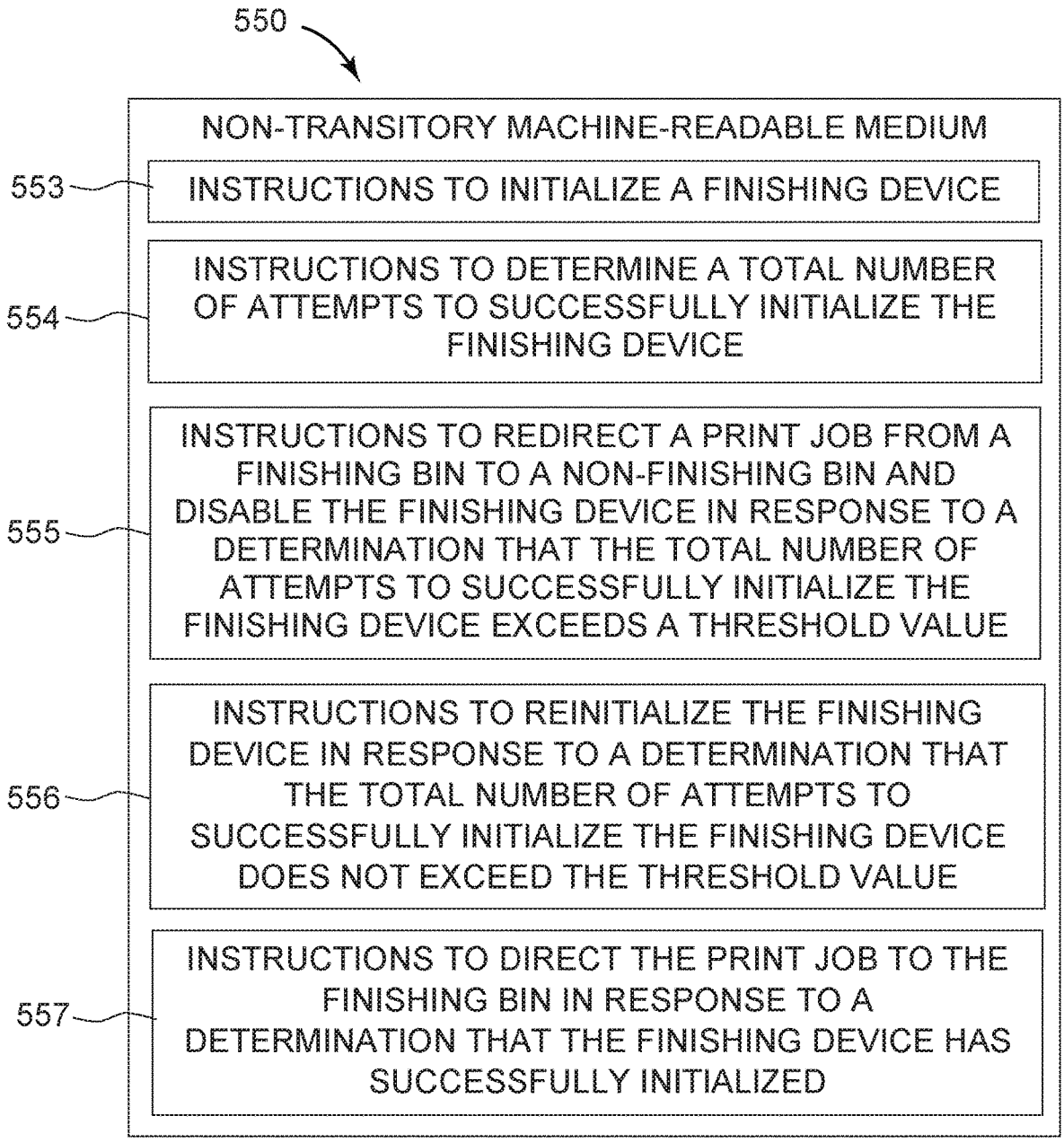
FIG. 5 illustrates an example diagram of a non-transitory machine-readable medium.

FIG. 5 illustrates an example diagram of a non-transitory machine-readable medium 550 including a printing device. A processing resource may execute instructions stored on the non-transitory machine-readable medium 550. The non-transitory machine-readable medium 550 may be any type of volatile or non-volatile memory or storage, such as random-access memory (RAM), flash memory, read-only memory (ROM), storage volumes, a hard disk, or a combination thereof.

The non-transitory machine-readable medium 550 stores instructions 553 executable by a processing resource to initialize a finishing device. In some examples, before print media sent to the finishing device for the finishing process the finishing device may undergo a successful initialization. Upon successful initialization of the finishing device and after the printing device processes print media the print media may be sent to a finishing device for a finishing process. That is, the processing resource may determine if the finishing device mechanisms are functioning properly and capable of performing a finishing process upon the initialization of the finishing device.

The non-transitory machine-readable medium 550 stores instructions 554 executable by a processing resource to determine a total number of attempts to successfully initialize the finishing device. In some examples, the finishing device may not be able to perform a finishing process on the print media. That is, if the finishing device fails to successfully initialize within a set number of times the finishing device may not be able to perform a finishing process. In some examples, if the finishing device fails to successfully initialize after a set number of attempts it may be disabled. That is, in order for the printing device to produce print media to the user the finishing device may be disabled and the print media may be sent to a non-finishing bin.

The non-transitory machine-readable medium 550 stores instructions 555 executable by a processing resource to redirect a print job from a finishing bin to a non-finishing bin and disable the finishing device in response to a determination that the total number of attempts to successfully initialize the finishing device exceeds a threshold value. In some examples, the print media may be redirected to a non-finishing bin if the finishing device is unable to perform a finishing process. By redirecting the print media to a non-finishing bin the print process is able to continue, thereby allowing a user to receive the print media from the print job. That is, if the total number of attempts to successfully initialize the finishing device exceeds a threshold value, print media may be redirected to the non-finishing bin thereby allowing the printing process to continue.

The non-transitory machine-readable medium 550 stores instructions 556 executable by a processing resource to reinitialize the finishing device in response to a determination that the total number of attempts to successfully initialize the finishing device does not exceed the threshold value. In some examples, the processing resource may execute instructions to reinitialize the finishing device in efforts to successfully initialize the finishing device for a finishing process. That is, if the total number attempts to successfully initialize the finishing device does not exceed the threshold value the processing resource may continue to initialize a finishing device.

The non-transitory machine-readable medium 550 stores instructions 557 executable by a processing resource to direct the print job to the finishing bin in response to a determination that the finishing device has successfully initialized. In some examples, if the finishing device successfully initializes the print media may undergo a finishing process and then exit the printing device through a finishing bin. However, in some examples, the finishing device may not successfully initialize on the first attempt and another attempt to successfully initialize the finishing device is conducted. If the finishing device successfully initializes after a reinitialization attempt the print media from the print job may be sent to a finishing bin. That is, subsequent to a successful reinitialization of the finishing device, print media may be directed to a finishing bin after the finishing process.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the detailed description. In addition, the proportion and the relative scale of the elements provided in the figures are intended to illustrate the examples of the detailed description, and should not be taken in a limiting sense.

It should be understood that the descriptions of various examples may not be drawn to scale and thus, the descriptions may have a different size and/or configuration other than as shown therein.

What is claimed:

1. A printing device comprising:

a first bin to receive print media, wherein the first bin is a non-finishing bin;

a second bin to receive print media, wherein the second bin is a finishing bin;

a finishing device; and a controller to:

determine a total number of finishing device failures; and redirect a print job from the second bin to the first bin in response to a determination that the total number of finishing device failures exceeds a threshold value.

2. The printing device of claim 1, wherein the controller is to determine whether the second bin is at capacity in response to signals received from a second bin sensor.

3. The printing device of claim 2, wherein the controller is to send a request to empty the second bin in response to reception of a signal from the second bin sensor indicative that the second bin is at capacity.

4. The printing device of claim 1, wherein the threshold value is a user-defined threshold value.

5. The printing device of claim 1, wherein the total number of finishing device failures exceeds the threshold value in response to the finishing device indicating a permanent failure.

6. The printing device of claim 1, wherein the controller is to disable the finishing device in response to the determination that the total number of finishing device failures exceeds the threshold value.

7. The printing device of claim 1, wherein the total number of finishing device failures, as stored in a memory resource, resets to zero in response to a successful initialization of the finishing device.

8. A method comprising:

attempting to power up a finishing device;

determining whether a finishing device failure occurred;

incrementing a counter in response to a determination that the finishing device failure occurred after attempting to power up the finishing device;

reattempting to power up the finishing device and incrementing the counter responsive to the finishing device failure;

determining based on the counter that a total number of finishing device failures exceeds a threshold value;

disabling the finishing device in response to a determination that he total number of finishing device failures exceeds the threshold value; and redirecting a print job to a first bin in response to the determination that the total number of finishing device failures exceeds the threshold value, wherein the first bin is a non-finishing bin.

9. The method of claim 8, further comprising determining if the finishing device failure has occurred by determining whether a media support sensor responds to a controller and is able to identify if a media support is aligned with a channel of the finishing device.

10. The method of claim 8, further comprising determining if the finishing device failure has occurred by determining whether a diverter responds to a controller.

11. The method of claim 8, further comprising determining if the finishing device failure has occurred by determining whether a bin sensor responds to a controller.

12. A non-transitory machine-readable medium storing instructions executable by a processing resource to:

initialize a finishing device;

determine a total number of attempts to successfully initialize the finishing device; and redirect a print job from a finishing bin to a non-finishing bin and disable the finishing device in response to a determination that the total number of attempts to successfully initialize the finishing device exceeds a threshold value.

13. The medium of claim 12, further comprising instructions to:

reinitialize the finishing device in response to a determination that the total number of attempts to successfully initialize the finishing device does not exceed the threshold value; and subsequent to reinitializing the finishing device, direct the print job to the finishing bin in response to a determination that the finishing device has successfully initialized.

14. The medium of claim 12, wherein the finishing device fails to successfully initialize if the finishing device does not power up.

15. The medium of claim 12, wherein the finishing device fails to successfully initialize if the finishing bin is not properly positioned.

* * * * *